US005398879A

United States Patent [19]

Rueth

[11] Patent Number: 5,398,879

[45] Date of Patent: Mar. 21, 1995

[54] CARRIER FOR PREVENTING RELATIVE MOVEMENT BETWEEN BOBBIN TUBE AND CARRIER

[75] Inventor: Gregor Rueth, Moenchen-Gladbach, Germany

[73] Assignee: W. Schlafhorst AG & Co., Moenchen-Gladbach, Germany

[21] Appl. No.: 63,876

[22] Filed: May 18, 1993

[30] Foreign Application Priority Data

May 30, 1992 [DE] Germany ..... 42 17 980.7

[51] Int. Cl.[6] ..... B65H 49/06

[52] U.S. Cl. ..... 242/129.5; 242/164

[58] Field of Search ..... 242/129.5, 164

[56] References Cited

U.S. PATENT DOCUMENTS

| | | | |
|---|---|---|---|
| 3,139,242 | 6/1964 | Banlier | 242/129.5 X |
| 3,285,528 | 11/1966 | Beindorf | 242/129.5 X |
| 3,811,636 | 5/1974 | Muchnick | 242/129.5 |
| 4,601,434 | 7/1986 | Mori et al. | 242/164 X |
| 5,110,064 | 5/1992 | Kimura et al. | 242/129.5 |

FOREIGN PATENT DOCUMENTS

| | | | |
|---|---|---|---|
| 1218916 | 6/1966 | Germany . | |
| 7301717 | 5/1973 | Germany . | |
| 3225987A1 | 2/1991 | Germany . | |
| 4016466A1 | 11/1991 | Germany . | |
| 4137743A1 | 5/1992 | Germany . | |
| 3235441A1 | 4/1993 | Germany . | |
| 52-25139 | 8/1975 | Japan . | |
| 335407 | 11/1928 | United Kingdom | 242/129.5 |

*Primary Examiner*—Daniel P. Stodola
*Assistant Examiner*—William Stryjewski
*Attorney, Agent, or Firm*—Shefte, Pinckney & Sawyer

[57] ABSTRACT

An improved carrier for textile bobbins of the type having a disk-like base plate and a bobbin mounting pin upstanding therefrom of an outside diameter slightly smaller than the inside diameter of the tube of the bobbin to be supported and transported, wherein the pin is equipped with a frictional non-slip surface. As a result, if pointwise contact with the inside diameter of the tube occurs, e.g., by relative tilting of the tube, friction is brought to bear to counteract shifting of the tube on the pin. The invention is based on the recognition that in every situation in which relative motion between the bobbin and the carrier occurs, the bobbin becomes tilted on the carrier. The non-slip surface of the pin advantageously comprises an elastic surface, e.g., rubber or silicone. According to another aspect of the present invention, the pin diameter can be adapted to various inside diameters.

6 Claims, 4 Drawing Sheets

CARRIER FOR PREVENTING RELATIVE MOVEMENT BETWEEN BOBBIN TUBE AND CARRIER

BACKGROUND OF THE INVENTION

The invention relates to carriers for transporting a textile bobbin, and more particularly to carriers of the type having a generally flat disk-like base and a pin or post upstanding centrally from the base for use in supporting and transporting textile yarn bobbins and tubes.

Transport systems in which carriers circulate on transport paths formed by rail-like transport channels for the base plates of the carriers are known for supporting and transporting textile cops, for example, as disclosed by Japanese Patent Disclosure A 52-25139, A pin or post extends from the disk-like base plate of each carrier and is telescopically received within the hollow end of the bobbin in order to support and hold it in upstanding disposition on the base plate. The outside diameter of the pin or post is slightly smaller than the inside diameter of the tube of the bobbin to be transported, to assure problem-free mounting and doffing of the bobbin, Carriers of this basic type are used for automatic bobbin winders, in which the carriers circulate in a transport loop, as described for example by German Patent DE 32 35 442 A1. The cops remain mounted on these carriers for the duration of the time they spend in processing stations of the winder and over long portions of the transport path system, In order to produce the necessary rotary motion of the cops in a cop preparation station, this German patent proposes that rotary motion of the carrier be resisted by means of retaining elements, while driven friction wheels placed at the base of the cop transmit the desired rotary motion directly to the cop. Disadvantageously, any windings that may be present at the base of the cop are wedged in place by the friction wheel and hence cannot be loosened.

By comparison, driving the carriers themselves has the advantage that the drive elements have no contact with the cop. To assure that the cop will be carried along in this transfer of drive motion, German patent DE 40 16 466 A1 proposed providing the pin or post with an elastic element whose outside diameter in a relaxed unstressed state is greater than the inside diameter of the textile bobbin tube, yet is sufficiently compressible to enable the pin or post to receive the base end of the tube. Although the frictional gripping force attained in this way does assure satisfactory driving of the cop when the carrier is driven and also assures that no shifting of the bobbin on the pin or post occurs if vertical forces are applied to the cop, mounting the bobbin on the pin or post and doffing it requires the exertion of relatively strong forces. Gripper devices used for this purpose must therefore exert relatively significant pressing forces, particularly if tolerances in production of the bobbin tube cause the inside diameter of some tubes to be below a standard size.

SUMMARY OF THE INVENTION

It is therefore the object of the present invention to propose an improved carrier which will enable enhanced handling of the textile bobbins in connection with carrier transport systems.

Briefly summarized, the improved carrier of the present invention basically comprises a disk-like base plate and a pin extending in upstanding disposition from the base plate for telescopical receipt within the tube of a bobbin, wherein the outside diameter of the pin is slightly smaller than the inside diameter of the tube of the bobbin to be supported and transported. According to the invention, the pin has a slippage-resistant elastic surface that is sufficiently frictional with respect to the interior surface of the tube for counteracting shifting of the tube on the pin which produces substantially pointwise contact of the pin with the interior surface of the tube.

The invention is based on the recognition that in every case in which relative motion between the bobbin and the carrier is brought about by external forces, the bobbin tilts relative to the pin or post on which it is mounted. Accordingly, provision is made so that the central longitudinal axes of the bobbin and the carrier will match when the bobbin is being mounted or doffed. Therefore, if the outside diameter of the pin or post is slightly smaller than the inside diameter of the tube, problem-free mounting and doffing of the bobbins can still be accomplished. Conversely, if the bobbin becomes tilted, the result is contact of the tube base with the lower part of the pin or post at one point, and contact of the inside surface of the bobbin tube with an upper edge of the pin or post at a point located above that point but offset from it by 180°. At these two points, the non-slip surface of the pin or post frictionally counteracts shifting or relative motion between the bobbin and the carrier. This problematic relative motion between the bobbin and the carrier can thus be effectively prevented.

By way of example, and as already mentioned, such relative motion between the bobbin and the carrier can occur at a cop rotation station inside a cop preparing device whereat a yarn separator for the reserve winding yarn may be pressed against the cop package, thereby tilting the cop, or the cop may be tilted by the suction toward a suction slit of a suction nozzle used to locate the yarn end. It is also possible in the winding station of a bobbin winder when rewinding relatively strong yarns that the yarn does not break readily, even when caught on the cop package, which is located outside the longitudinal axis of the cop tube, thereby causing the cop to tilt. The force of friction of the cop tube on the carrier pin, which now acts in addition to the cop weight, increases the force that counteracts yarn tension to such an extent that the yarn breaks. As a result, the nuisance of doffing the cop from the carrier becomes unnecessary. A third possible manner in which relative motion arises between the bobbin and the carrier is known as cop bridges, at which the carrier and cop are pivoted by approximately 90°. In an extreme case, with conventional carriers, the cops can slide off the pin and fall off the cop bridge. This is also prevented by the present invention, since the cop in its horizontal position likewise tilts with respect to the pin, because its center of gravity is located outside the pin.

In preferred embodiments of the present carrier, the pin may be provided with a conical protrusion, e.g., at the base of the pin, which has the same slippage-resistant elastic surface as the pin. Preferably, the elastic surface is formed of rubber. In certain embodiments, the elastic surface may include at least one separable component which is selectively removable from and fixable to the pin. Adjusting means may be disposed in an interior area of the pin for selectively varying the outside pin diameter in order to adapt to tubes having different inside diameters. It is also contemplated that the pin may be formed unitarily of an elastic material.

The conical protrusion at the lower end of the pin serves not only to center the bobbin but also to increase the force of friction when a rotary motion is transmitted from the carrier to the bobbin. This arrangement also insures that the bobbin will be carried along with the rotary drive of the carrier at rotation stations that have a centering device that can be placed into contact with the bottom tube from thereabove.

The provision of an elastic surface, e.g., rubber or silicone, is especially advantageous because on the one hand it provides a highly non-slip surface while on the other it is sufficiently resilient to yield somewhat when tilting occurs, which increases the surface area of contact between the bobbin tube and the pin.

An interchangeable elastic surface affords the possibility of not having to replace the entire pin or even the entire carrier in case of wear. Moreover, elastic layers of different thicknesses can be used, making the carrier usable for different inside diameters of bobbins tubes.

Another option for varying the outside diameter of the pin, in order to adapt to different inside tube diameters, is to provide an adjusting means in the interior of the pin.

However, the pin may also be made integrally of an elastic material. An entire pin of this kind can also be replaced, so that the applicable carrier can then also be used for different inside tube diameters.

The invention will be described in further detail below in terms of exemplary embodiments.

DESCRIPTION OF THE PREFERRED EMBODIMENT

In all the embodiments shown, the carrier 1 has a circular disk-like platter-shaped base plate 2 and a central pedestal 3 extending upwardly from the center of one side of the base plate. By way of example, this pedestal 3 can be utilized to guide the carrier along its transport path or may form a contact surface for stop elements in processing stations. Protruding from the pedestal 3 is a reduced-diameter base 4 for the particular pin of each respective embodiment.

Figure 1:
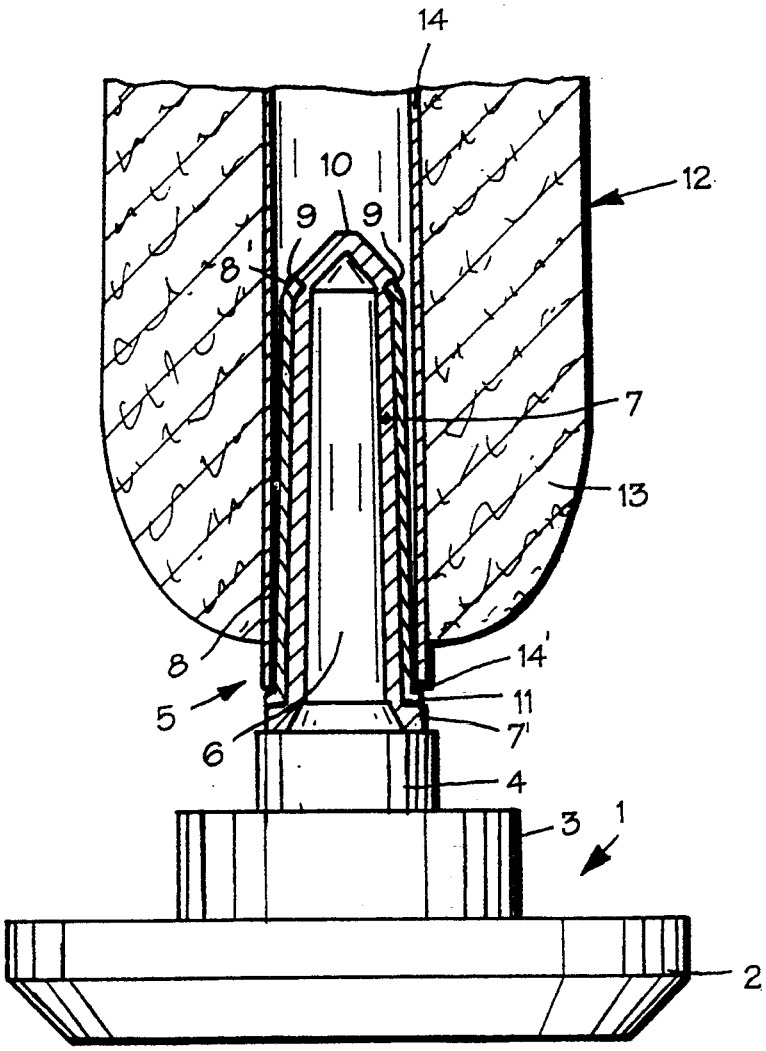
FIG. 1 is a side view of a carrier according to one preferred embodiment of the present invention, with the pin and the bobbin mounted thereon shown in vertical cross-section.
Figure 2:
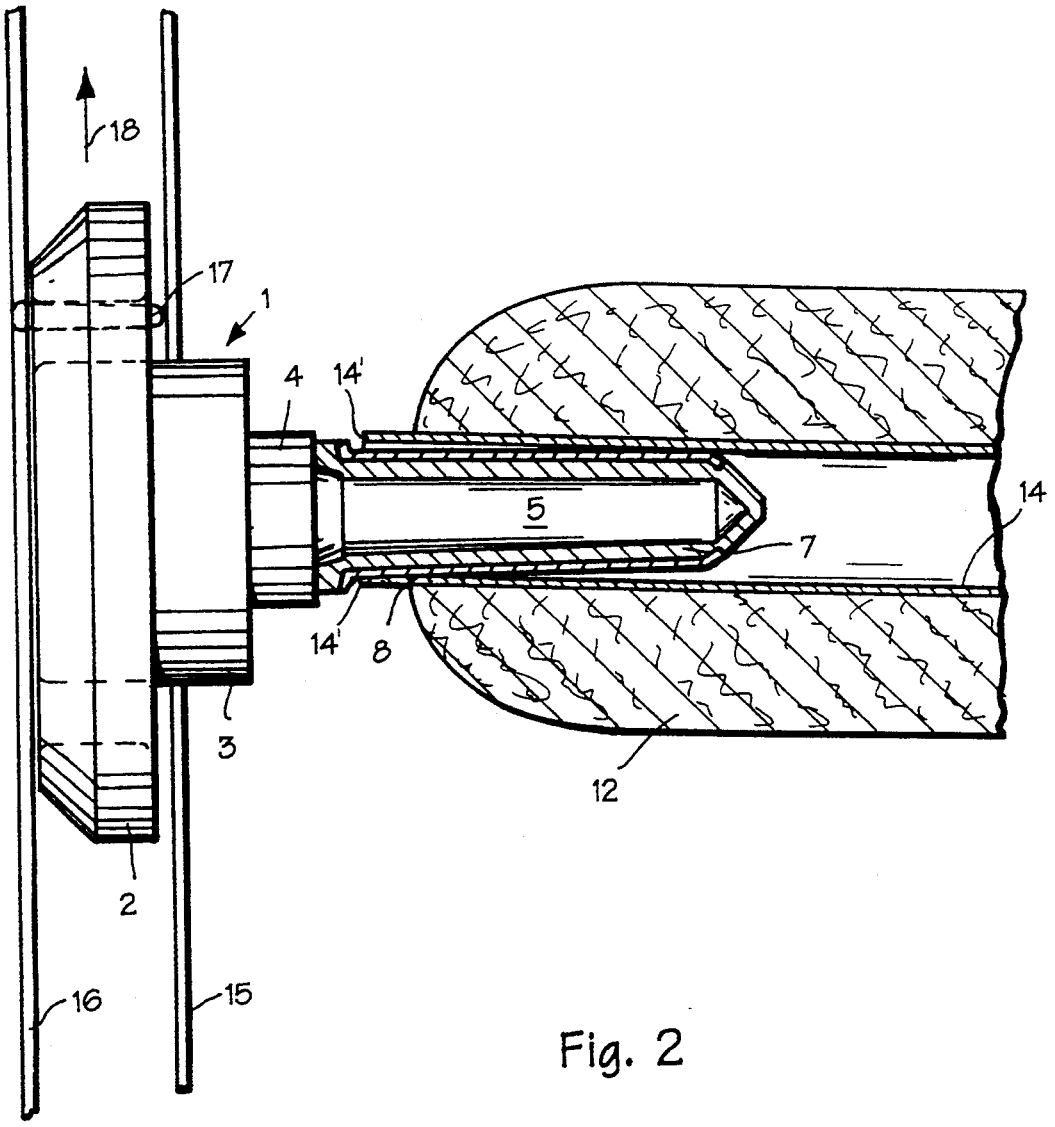
FIG. 2 shows the carrier and the bobbin of FIG. 1 during vertical transport along a cop bridge.

In the embodiment of a caddy 1 shown in FIGS. 1 and 2, the pin substantially comprises a hollow pin profile 7 that surrounds an open interior space 6. This pin profile 7 is substantially cylindrical and has a conical tip 10 at the outer free end of the pin that is intended to make it easier to mount a cop 12 thereon. At the transition between the cylindrical body of the pin profile 7 and the conical pin tip 10, an annular groove 9 is formed.

A rubber sheath 8 is slipped over the pin profile 7 and has a flange-like annular rib or profile 8' extending inwardly at its upper end so that, when the rubber sheath 8 has been slipped completely onto the pin profile 7, the annular rib 8' locks into the annular groove 9. At its other end, the rubber sheath 8 engages a flange 7' at the base of the profile 7. As a result, the rubber sheath 8 is conformingly fitted and essentially locked with respect to the pin profile 7 to secure the sheath against vertical shifting movement. The rubber sheath 8, in its relaxed state, has a smaller inside diameter as compared with the outside diameter of the cylindrical portion of the pin profile 7. As a result, the rubber sheath 8 rests firmly against the circumference of the profile 7. Hence, shifting of the sheath on the pin profile 7 is resisted and is possible only if relatively major force is exerted.

At its lower end, the rubber sheath 8 has a conical protrusion 11, which as can be seen in FIG. 1, aids in centering the tube 14 of the cop 12 and in so doing, forms a support for the tube base 14'. When thusly centered, the tube 14 that carries the yarn winding package 13 has contact only with the conical protrusion 11, with a slight air gap existing between the inside surface of the tube 14 and the outside surface of the rubber sheath. This situation typically prevails during cop transport and during operations at a processing station having a centering device. In the latter case, the non-slip surface of the conical protrusion 11 assures that any rotary motion transmitted to the carrier can also be transferred to the cop 12.

In the example of FIG. 2, as already noted, a vertical segment of a cop bridge is shown. A cop bridge of this kind is disclosed in German Patent DE 40 15 173 A1, for example. The base plate 2 of the carrier 1 has openings, interrupted by radially arranged spokes, that can be engaged by a peg 17 of a transport chain 16 to enable the carriers to be carried along in the direction of the arrow 18 by direct positive connection with the chain. Guide profiles 15 assure that the applicable carrier 1 cannot disengage the peg 17 and hence depart from its transport path.

The illustration in FIG. 2 is only one of the examples in which tilting of the cop relative to the carrier takes place, producing frictional forces therebetween. The same situation arises if a reserve winding yarn separator is pressed against the cop surface approximately at the level of the center of gravity of the cop, i.e., substantially outside the portion of the cop tube telescoped on the pin. If the cop is located next to a suction slit or opening, then tilting also takes place as a result of the suction force. In this way, the rotary motion can be effectively transmitted from the carrier to the cop.

As is known, in the unwinding position in the winding station of an automatic winder, yarns can catch on one another. This occurs principally on the yarn windings themselves, i.e., at a distance from the center axis of the cop being unwound. Because of the strong tensile force on the yarn that arises suddenly at the instant a yarn catch occurs, both a vertical component of force and a horizontal component of force are created, which hereagain causes tilting of the cop, with the result that the frictional force between the cop and the carrier pin is increased. As a result, such frictional force together with the force already existing because of the weight of the cop that counteracts the tensile force on the yarn is increased so markedly that the yarn is caused to break without the cop being pulled off the pin of the carrier. Problems in the winding station can be averted in this way.

Figure 4:
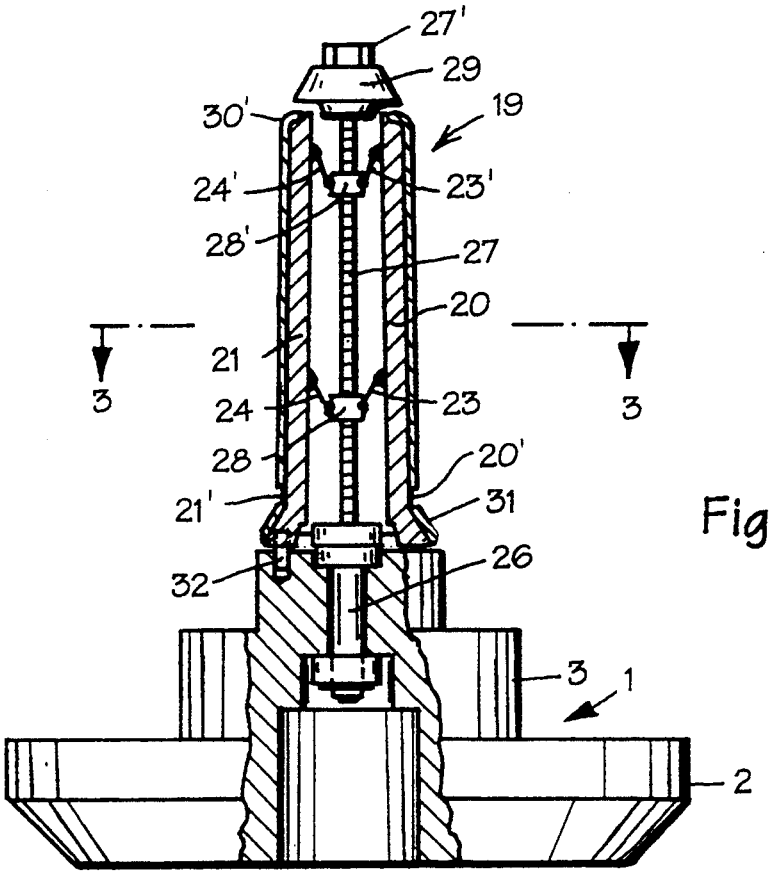
FIG. 4 shows the carrier of FIG. 3 in a side view shown partially in vertical cross-section taken along lines A—A of FIG. 3.
Figure 3:
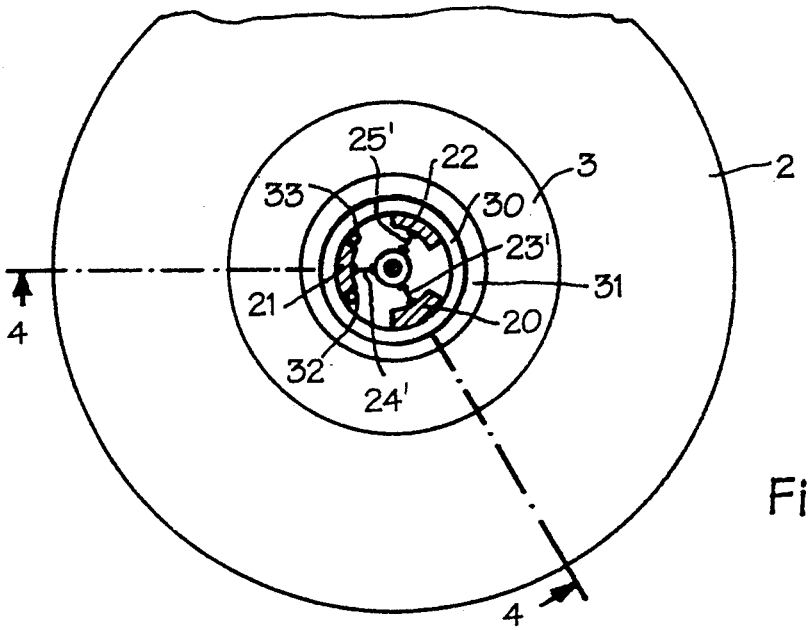
FIG. 3 is a horizontal section through a pin of an alternative embodiment of the carrier according to the present invention, whose outside diameter is adjustable.

In the embodiment shown in FIGS. 3 and 4, a carrier is equipped with means for adjusting the diameter of the pin 19. Three support rails 20,21,22 extend substantially parallel to the longitudinal axis of the pin 19 and are spaced apart by approximately equal angles from one another. The radially outward surfaces of the rails 20,21,22 collectively carry a rubber sheath 30. Like the embodiment of FIG. 1, the rubber sheath 30 has a flange-like annular profile 30' that extends inwardly and fits over the support rails 21,20,22 at their upper ends at which the upper end of the rubber sheath 30 abuts a flange-like protrusion 20,21,22 of each respective support rail 20,21,22. A separate conical rubber ring 31 is fitted annularly about the opposite base ends of the rails 20,21,22 to perform the same function as the conical protrusion 11 of the rubber sheath 8 in FIG. 1.

The support rails 20,21,22 are each held by a pair of struts 23,24,25 and 23' 24' 25' respectively, which are disposed one above the other and are pivotably connected both to the respective support rails 20,21,22 and to a pair of threaded collets 28,28' respectively, which are disposed on a threaded spindle 27 The spindle 27 is connected via a spindle bearing 26 to the base 4 of the caddy 1 and is rotatably supported therein. The threaded spindle 27 has a spindle head portion 27' which may be formed with a hexagonal outer drive surface, a hexagonal socket drive recess, or a drive slit or slot. With the aid of an appropriate tool, the threaded spindle 27 can thereby be rotated by the head portion 27', which in turn vertically adjusts the threaded collets 28,28'. If the threaded collets 28,28' are adjusted downward, the support rails 20,21,22 abut the base 4, while if they are adjusted upward, these support rails abut the preferably smooth underside of a pin tip 29 which is advantageously disposed rotatably on an unthreaded portion of the threaded spindle 27 and as a result is not affected by the rotary motion of the threaded spindle 27.

To prevent twisting of the support rails 20,21,22 during such adjustments, bolts 32,33 may be fastened to the base 4 of the caddy 1 on both sides of the support rail 21. Because of the connection of the support rails to one another via the threaded collets 28,28' these two bolts 32,33 are sufficient to prevent twisting of the rails. However, for additional stability, such bolts may also be provided at opposite sides of the other support rails 20,22 as well.

Since the support rails 20,21,22 are secured in vertical disposition, they are moved radially outward if the threaded collets 28,28' shift vertically upward as viewed in FIG. 4. As will be understood, if the struts 23,24,25 and 23' 24' 25' are extended outwardly into a horizontal position, the dimension of radial extension of these struts is thereby increased.

Since the distances traveled by the threaded collets 28,28' upon rotation of the threaded spindle 27 are the same, the support rails 20,21,22 are shifted radially outward by the same amount over their entire length. The elastic rubber sheath 30 is stretched accordingly in the process. Hence, the pin 19 is adapted to function with a larger tube diameter.

To make it easier to adjust the pin to the applicable inside diameter of a given tube, the threaded spindle head 27' may for instance be provided with a marking and the tip 29 may have a graduated scale.

Figure 5:
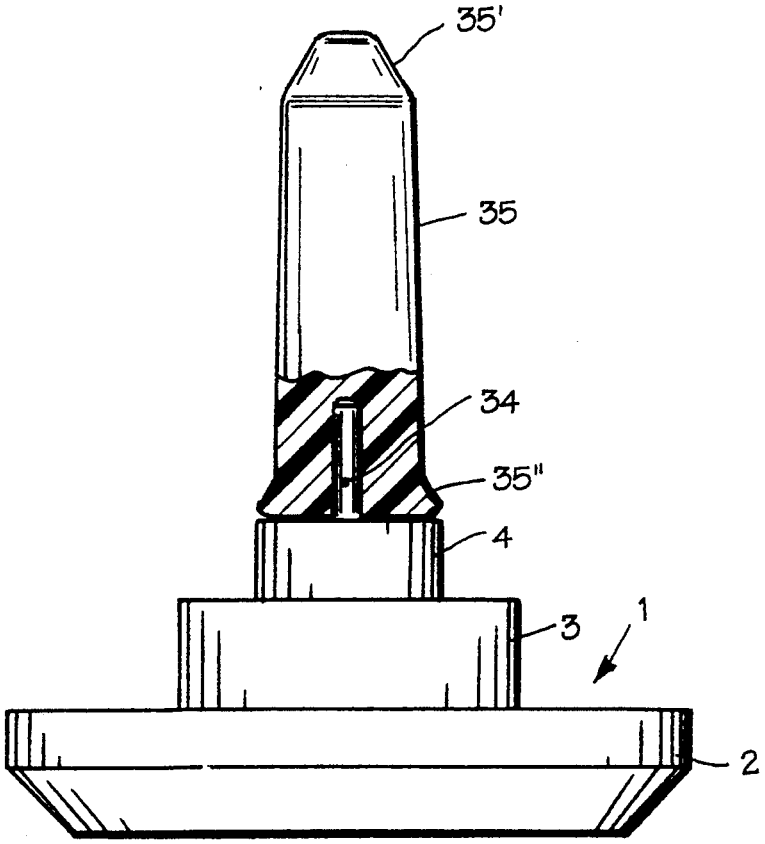
FIG. 5 is a partially sectioned side view of another embodiment of the carrier according to the present invention, with a one-piece pin.

In a third embodiment of a carrier 1 according to the present invention shown in FIG. 5, the base 4 has a vertical pin 34, onto which a molded unitary silicon body 35 is slipped. This molded silicone body can easily be replaced, thereby enabling this carrier 1 to be adapted to various inside tube diameters. The molded silicone body 35 also has a conical tip 35 to make it easier to mount a bobbin thereon and a conical protrusion 35" at the lower end of the body 35 above the base 4 analogously to the preceding examples.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A carrier for supporting and transporting a textile bobbin having a yarn-supporting tube, comprising a disk-like base plate and a pin including a first segment portion and a second segment portion, said pin extending in upstanding disposition from the base plate for telescopical receipt within the tube of the bobbin, an outside diameter of said first segment portion being slightly smaller than an inside diameter of the tube of the bobbin to be supported and transported and said second segment portion has a diameter greater than the inside diameter of the tube of the bobbin to be supported and transported for supporting an upright tube along an annular contact line therearound, the pin having a slippage-resistant surface to substantially prevent relative motion between the tube and said pin when the tube is in a tilted condition with respect to said pin resulting in contact between the tube and said pin at a first position on said first segment portion and a second position on said second segment portion so that the tube is returned to an upright condition, the tube and said pin remain substantially longitudinally coaxial.

2. The carrier of claim 1, wherein the pin includes a conical protrusion having a slippage-resistant elastic surface.

3. The carrier of claim 1, wherein the elastic surface comprises rubber.

4. The carrier of claim 1, wherein the elastic surface comprises at least one separable component which is selectively removable from and fixable to the pin.

5. The carrier of claim 1, and further comprising adjusting means disposed in an interior area of the pin for selectively varying the outside diameter of the pin in order to adapt to tubes having different inside diameters.

6. The carrier of claim 1, wherein the pin is formed unitarily of an elastic material.

* * * * *